United States Patent [19]

Biggs, Sr.

[11] Patent Number: 5,042,875

[45] Date of Patent: Aug. 27, 1991

[54] PORTABLE SEAT ASSEMBLY

[76] Inventor: Thomas S. Biggs, Sr., 86 Christen Ct., Lancaster, N.Y. 14086

[21] Appl. No.: 561,980

[22] Filed: Aug. 2, 1990

[51] Int. Cl.[5] ..... A47C 1/16

[52] U.S. Cl. ..... 297/252; 297/188; 297/452; 297/378; 297/382

[58] Field of Search ..... 297/188, 252, 440, 442, 297/443, 378, 382, 452, DIG. 2, 444

[56] References Cited

U.S. PATENT DOCUMENTS

| | | | |
|---|---|---|---|
| 2,092,666 | 12/1935 | Dietrich | 297/460 |
| 2,333,734 | 11/1943 | Nieltopp | 297/188 |
| 2,475,962 | 1/1947 | Horn | 297/252 |
| 2,545,840 | 10/1948 | Browne | 297/252 |
| 2,694,441 | 6/1953 | Degenfelder | 297/252 |
| 2,792,875 | 5/1957 | Pirrone | 297/252 |
| 2,841,207 | 7/1958 | Sweeney | 297/252 |
| 3,066,980 | 7/1961 | Clute | 297/252 |
| 4,555,140 | 11/1985 | Nemoto | 297/DIG. 2 X |
| 4,611,852 | 9/1986 | Filer | 297/252 |
| 4,674,631 | 6/1987 | Williams | 297/217 X |
| 4,715,652 | 12/1987 | Ward | 297/252 |

*Primary Examiner*—Kenneth J. Dorner
*Assistant Examiner*—Milton Nelson, Jr.
*Attorney, Agent, or Firm*—Sommer, Oliverio & Sommer

[57] ABSTRACT

A portable seat assembly (10) includes a seat member (16) and a back member (18). The seat member has a forward hook portion (36), and the back member has a rearward hook portion (70). The rearward hook portion includes two spaced L-shaped arms (71,71), connected by a cross-bar (74) which functions as a carrying handle. The back member may be folded to lie adjacent the seat member for ease in carrying, or may be moved to an upright position at which a plank-like support (11) will be captured between the forward and rearward hook portions. In its operative position, the back member provides support for a person sitting thereon.

10 Claims, 4 Drawing Sheets

PORTABLE SEAT ASSEMBLY

TECHNICAL FIELD

The present invention relates generally to a portable seat assembly, and, more particularly, to an improved portable seat assembly which may be conveniently carried in a folded-flat condition, and may be selectively manipulated to an operative position at which the seat assembly will lock onto a board-like support (e.g., a bleacher, etc.) and provide support for a person's back.

BACKGROUND ART

A bleacher typically includes a plurality of longitudinally-and vertically-staggered plank-like supports. Typically, a bleacher will provide one such plank for a person to sit upon, and another to support the person's feet. These planks are commonly no more than horizontally-elongated boards. Such bleachers are typically uncomfortable, and fail to support a person's back.

Accordingly, there is believed to be a need for a portable seat assembly which may be conveniently carried to and from the site of a sporting event or the like, and quickly manipulated to an operative position on site, which position will provide support for a person's back. In addition, such seat assembly may also provide a cushion. Moreover, such a seat should operatively engage the bleacher to prevent it from unintentionally separating therefrom.

DISCLOSURE OF THE INVENTION

With parenthetical reference to the corresponding parts, portions or surfaces of the disclosed embodiment, for purposes of illustration, the present invention provides an improved portable seat assembly (e.g., 10) which is adapted to be selectively mounted on a support (e.g., 11), such as a bleacher, having an upper surface (e.g., 12), a lower surface (e.g., 13), a front surface (e.g., 14), and a rear surface (e.g., 15). The improved seat assembly broadly includes: a seat member (e.g., 16) having a lower surface (e.g., 35) adapted to rest on the support upper surface, and having an upper surface (e.g., 21, 22) adapted to provide a seat for a person sitting thereon, the seat member also having a depending forward hook portion (e.g., 36) adapted to embrace and capture a forward marginal end portion of the support; and a back member (e.g., 18) pivotally mounted on the seat portion and adapted to be selectively moved between a folded position (e.g., as shown in FIG. 4), at which the back member lies adjacent to the seat member upper surface, and an upright position (e.g., as shown in FIG. 3) at which the back member extends away from the seat member and is adapted to engage and support the back of a portion seating on the seat member, the back portion having a depending rearward hook portion (e.g., 70) adapted to serve as a carrying handle when the back member is in its folded position and adapted to capture a rear marginal end portion of the support when the back member is in its upright position; whereby, when the back member is in its upright position and the two hook portions engage such opposing marginal end portions of the support, the seat assembly will be restrained from moving either forwardly or rearwardly relative to the support.

Accordingly, the general object of this invention is to provide an improved portable seat assembly.

Another object is to provide an improved lightweight portable seat assembly which may be readily carried or transported in a folded-flat condition.

Still another object is to provide an improved portable seat assembly which may be suitably moved from a folded-flat condition to an operative condition to provide support for the back of a person sitting thereon, and to grasp or capture a plank-like support so as to prevent the seat assembly from moving forwardly or rearwardly relative to the support when in such operative position.

These and other objects and advantages will become apparent from the foregoing and ongoing written specification, the drawings and the appended claims.

MODE(S) OF CARRYING OUT THE INVENTION

Figure 1:
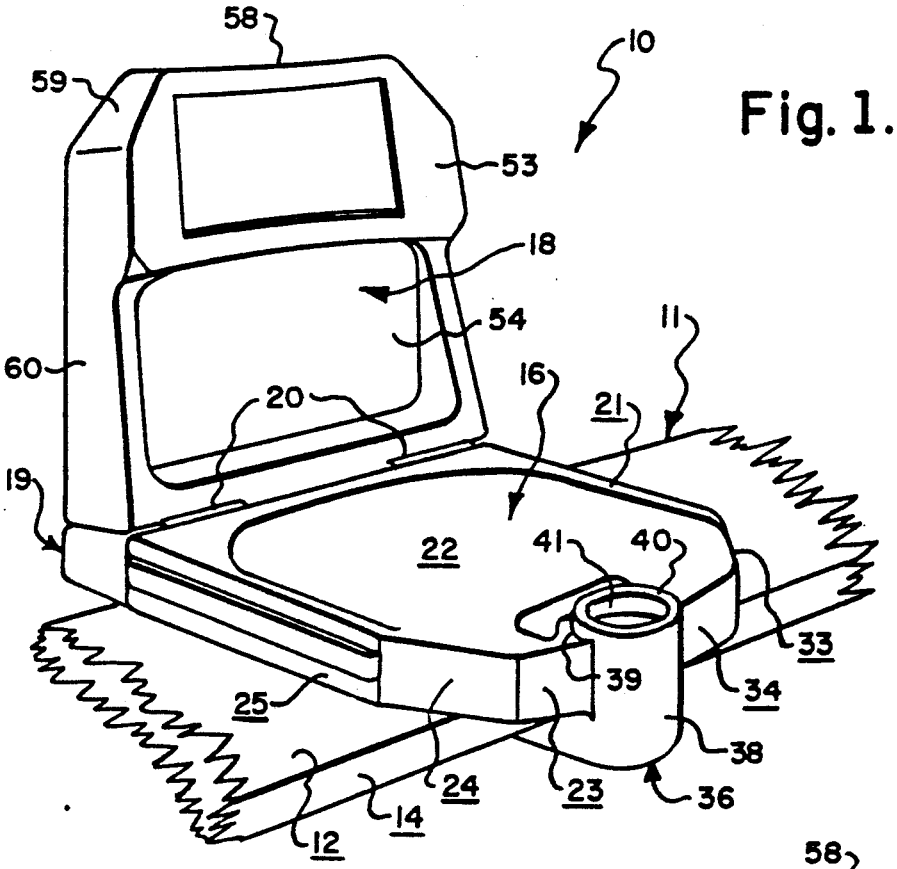
FIG. 1 is a left front perspective view of the improved seat assembly, this view showing the seat assembly as being in its operative upright position grasping a portion of a bleacher between its forward and rearward hook portions.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up"

and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate. Moreover, the notations, "forwardly" and "rearwardly" refer to the direction of the seat as a person faces when sitting thereon.

Figure 3:
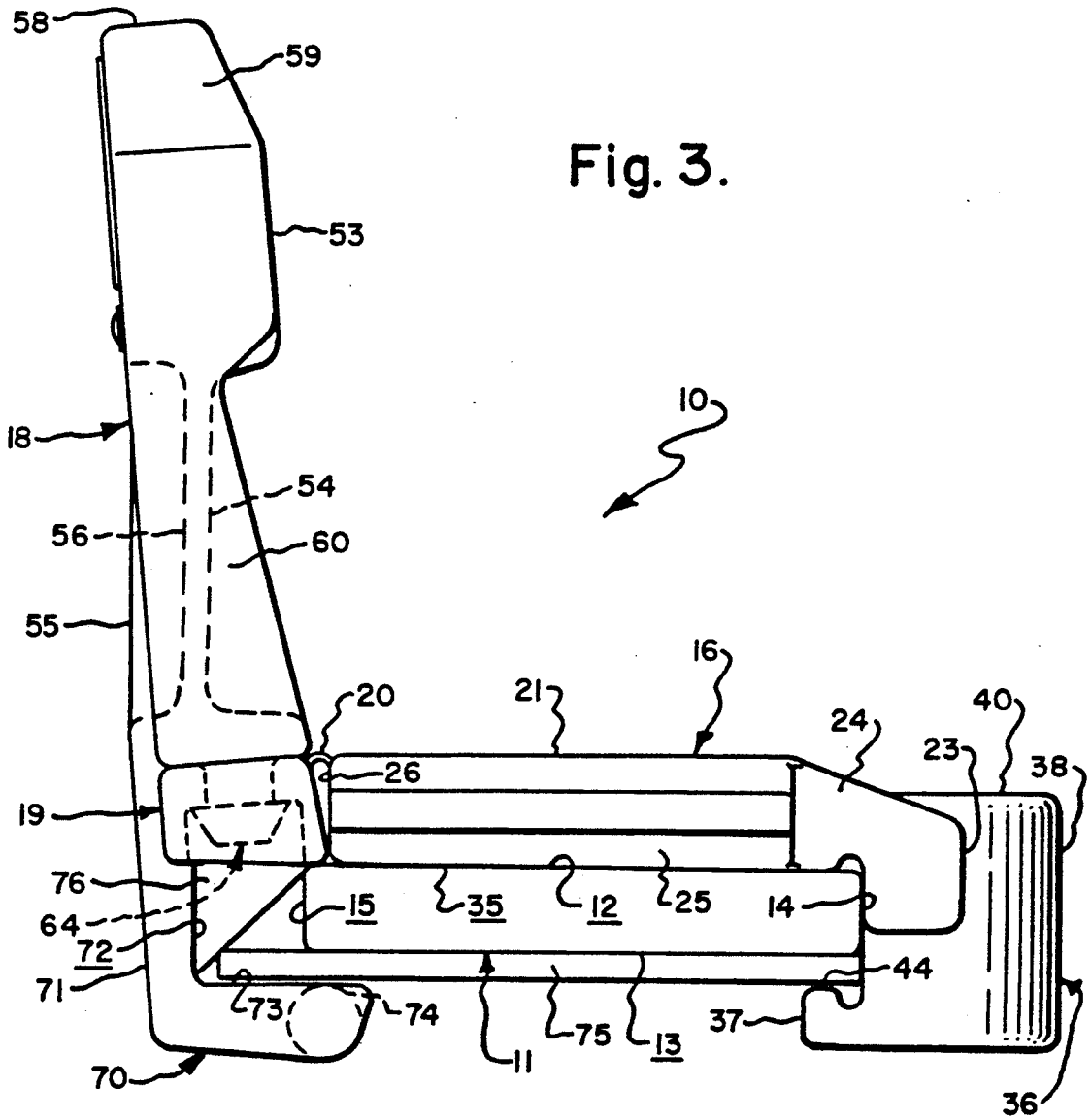
FIG. 3 is a left side elevation of the improved bleacher seat shown in FIGS. 1 and 2, this view also showing the forward and rearward hook portions as capturing a portion of a bleacher therebetween.
Figure 4:
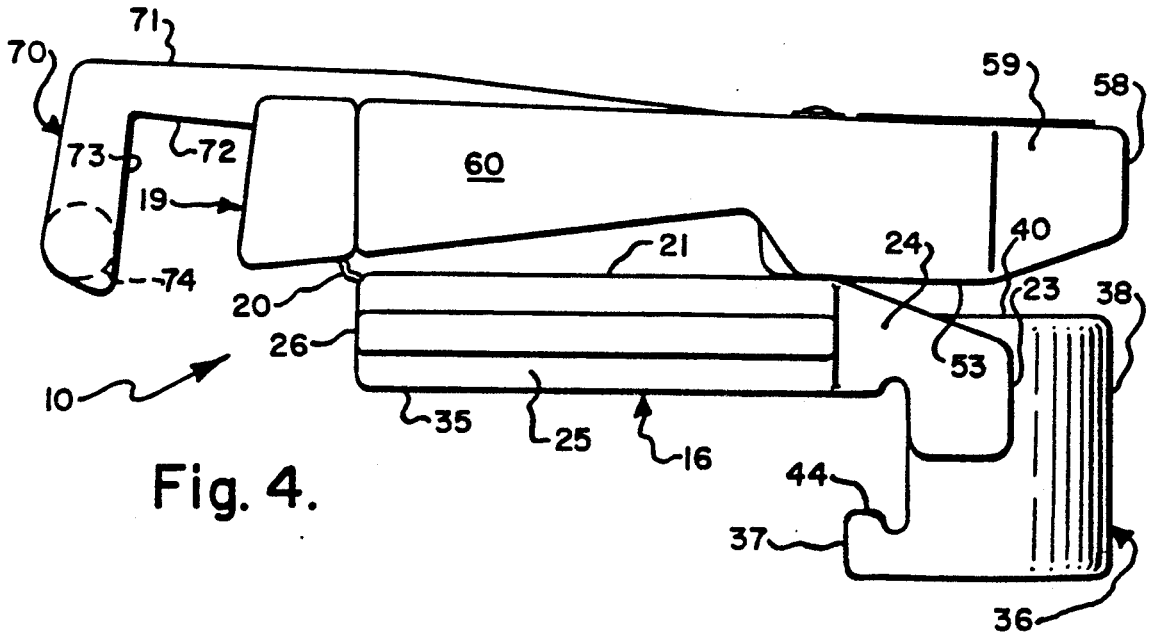
FIG. 4 is a left side elevational view generally similar to FIG. 3, but shows the back member as having been folded forwardly (i.e., in a clockwise direction as shown in FIG. 3) through an arc of approximately 95° to its folded condition.

Referring now to the drawings, this invention provides an improved portable seat assembly of which presently-preferred embodiment is generally indicated at 10. The improved seat assembly is adapted to be selectively moved between a folded condition, as shown in FIG. 4, and an operative or upright position, as shown in FIG. 3, in which the back member extends away from the seat member, as described infra. The improved seat assembly is adapted to selectively engage a board-or plank-like support 11, such as bleacher seat. In the accompanying drawings, the bleacher-type support as shown as being a horizontally-elongated member having a rectangular transverse cross-section, and is specifically bounded by a planar horizontal upper surface 12, a planar horizontal lower surface 13, a forwardly-facing planar vertical surface 14, and a rearwardly-facing planar vertical surface 15. While the improved seat assembly will be shown and described with reference to a bleacher-type seat, persons skilled in this art will readily appreciate that such seat may be used with other types of supports as well.

The improved seat assembly 10 is initially formed of two physically-separate blow-molded parts, namely, a seat member, generally indicated at 16, and a back member, generally indicated at 18. Seat member 16 includes a lower portion 19 connected to the balance of the seat member by an integrally-formed flexible web or "living hinge" 20.

Seat member 16 is shown as having a planar horizontal upper surface 21 and a form-fitted concave surface 22 configured to provide a comfortable cushioned seat for a person sitting thereon. The seat member is also shown as including a peripheral side surface, which sequentially includes a forwardly-facing planar vertical surface 23, a forwardly- and leftwardly-facing planar vertical surface 24, a leftwardly-facing planar vertical surface 25, a rearwardly-facing planar vertical surface 26, a rightwardly-facing planar vertical surface 28, a rearwardly-facing planar vertical surface 29, a leftwardly-facing planar vertical surface 30, a rearwardly-facing planar vertical surface 31 arranged to lie in the same plane as surface 26, a rightwardly-facing planar vertical surface 32, a forwardly-and rightwardly-facing planar vertical surface 33, and a forwardly-facing planar vertical surface-34. Seat member 16 is further shown as having a planar horizontal lower surface 35 adapted to rest on support upper surface 12.

A forward hook portion, generally indicated at 36, is shown as being molded integrally in the fowardmost portion of the seat member between surfaces 23,34. Hook portion 36 is shown as having a generally cylindrical outer surface 38 generated about a vertical axis. A portion of surface 38 extends vertically above the contoured surface 22 of the seat member to provide a thin-walled raised cylindrical collar 39. This collar is shown as having an uppermost annular surface 40 from which a blind recess 41 extends downwardly into the hook portion. More particularly, recess 41 is bounded by an inwardly-facing vertical cylindrical surface 42 extending downwardly from the inner margin of upper surface 40, and an upwardly-facing horizontal circular surface 43 forming the bottom of the recess. Recess 41 forms a receptacle for a beverage container, such as a can or bottle. The vertical leg of hook portion 36, this leg being defined by cylindrical surface 38, extends downwardly beneath the seat member lower surface 35. The forward hook portion 36 has a horizontal portion 37 extending rearwardly from the lower margin of cylindrical wall 38, and has a planar horizontal surface 44 in vertically-spaced facing relation to the seat member lower surface 35. Seat member 16 may be blow-molded of a high density polyethylene or the like, and is shown as having various walls of substantially constant thickness forming the various surfaces described herein.

Figure 6:
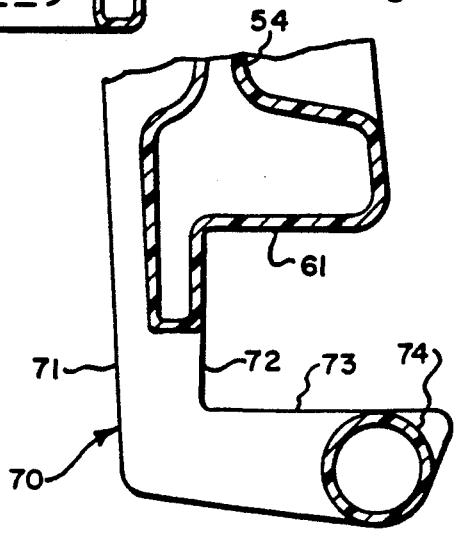
FIG. 6 is a fragmentary vertical sectional view thereof, taken generally on line 6—6 of FIG. 5, showing the manner by which the back member is attached to the lower portion of the seat member.
Figure 8:
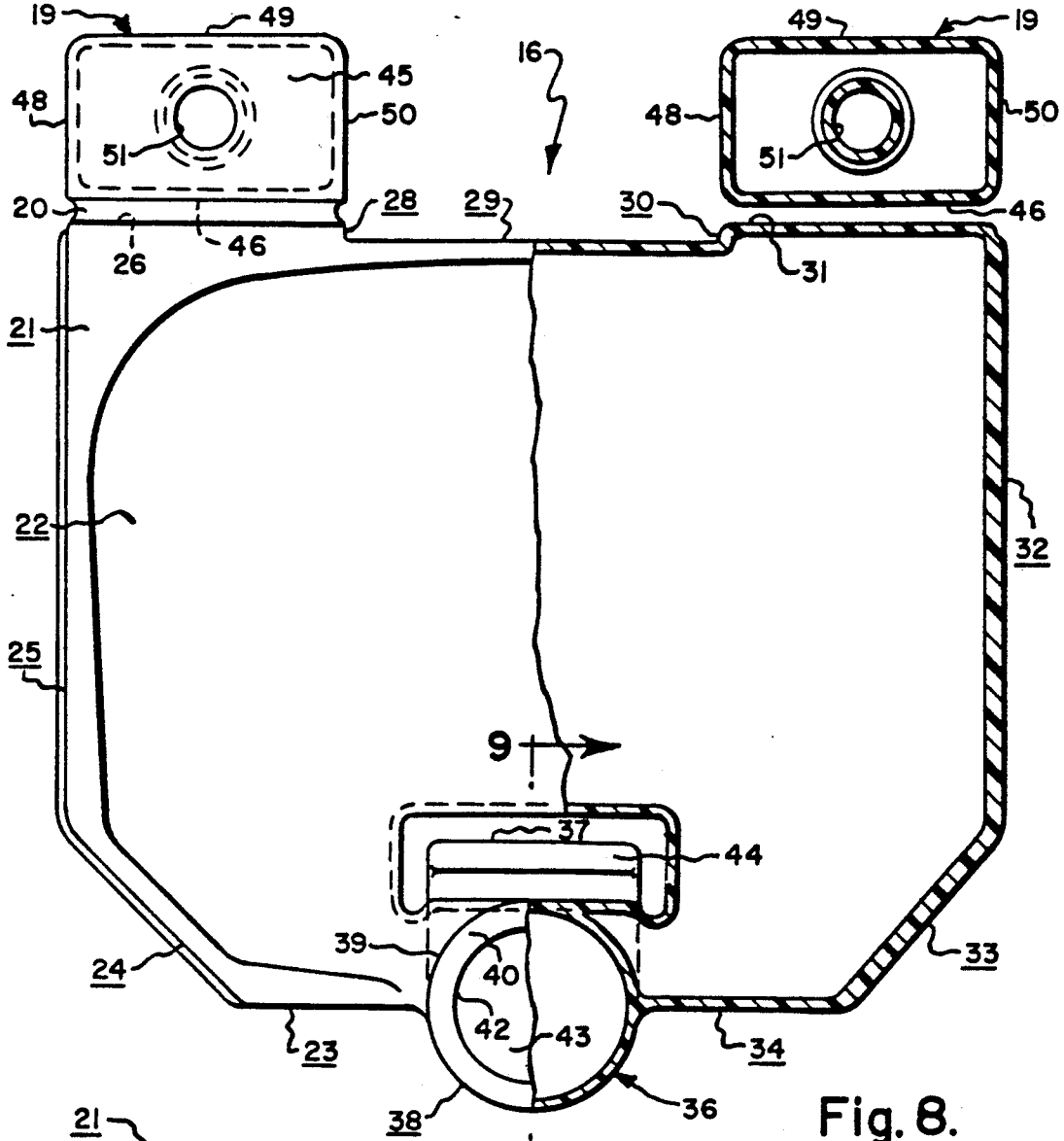
FIG. 8 is a top view, partly in elevation and partly in section, of the seat member, with the back member having been removed.
Figure 9:
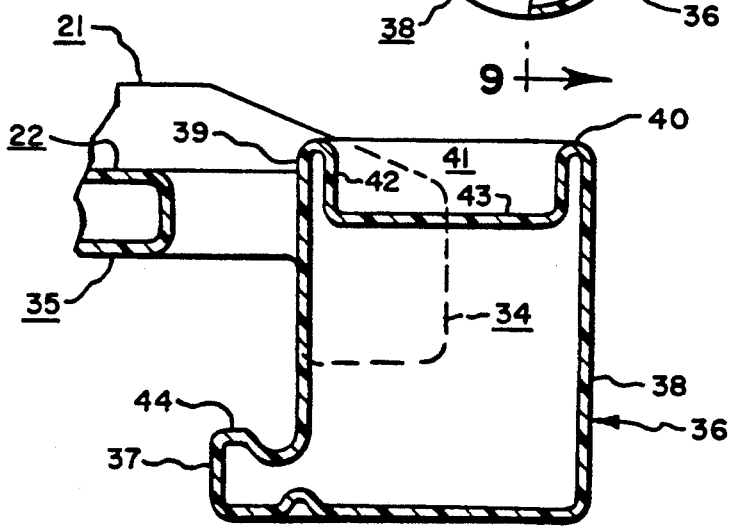
FIG. 9 is a fragmentary vertical sectional view thereof, taken generally on line 9—9 of FIG. 8, and shows the blind recess extending downwardly into the vertical leg of the forward hook portion, this view also showing the forward hook portion in transverse vertical cross-section.

As preveiously noted, two horizontally-spaced back portions 19,19 are formed integrally with the seat member, and are connected thereto by means of flexible webs 20,20, as shown in FIG. 8. Each of portions 19 is shown as presenting a generally rectangular outline, when viewed in top plan (FIG. 8), with a somewhat trapezoidal outline when viewed in central vertical cross-section (FIG. 6). Each portions 19 has an upper surface 45, and a peripheral side surface which sequentially includes: a forwardly-facing planar surface 46 adapted to face toward a proximate portion of seat member rear surface 26 or 31, as appropriate, a leftwardly-facing planar vertical surface 48, a rearwardly-facing planar surface 49, and a rightwardly-facing planar vertical surface 50. Each of portions 19 is molded with a central vertical through-opening 51. Since portions 19 are blow-molded, a downwardly-facing annular surface 52 about the opening is available as an abutment surface for a purpose hereinafter explained. Flexible webs 20,20 are formed integrally with portions 19,19 and seat member 16. More particularly, webs 20,20 join the intersection of surfaces 45,46 with seat member surfaces 21,26 and 21,31, respectively.

Figure 2:
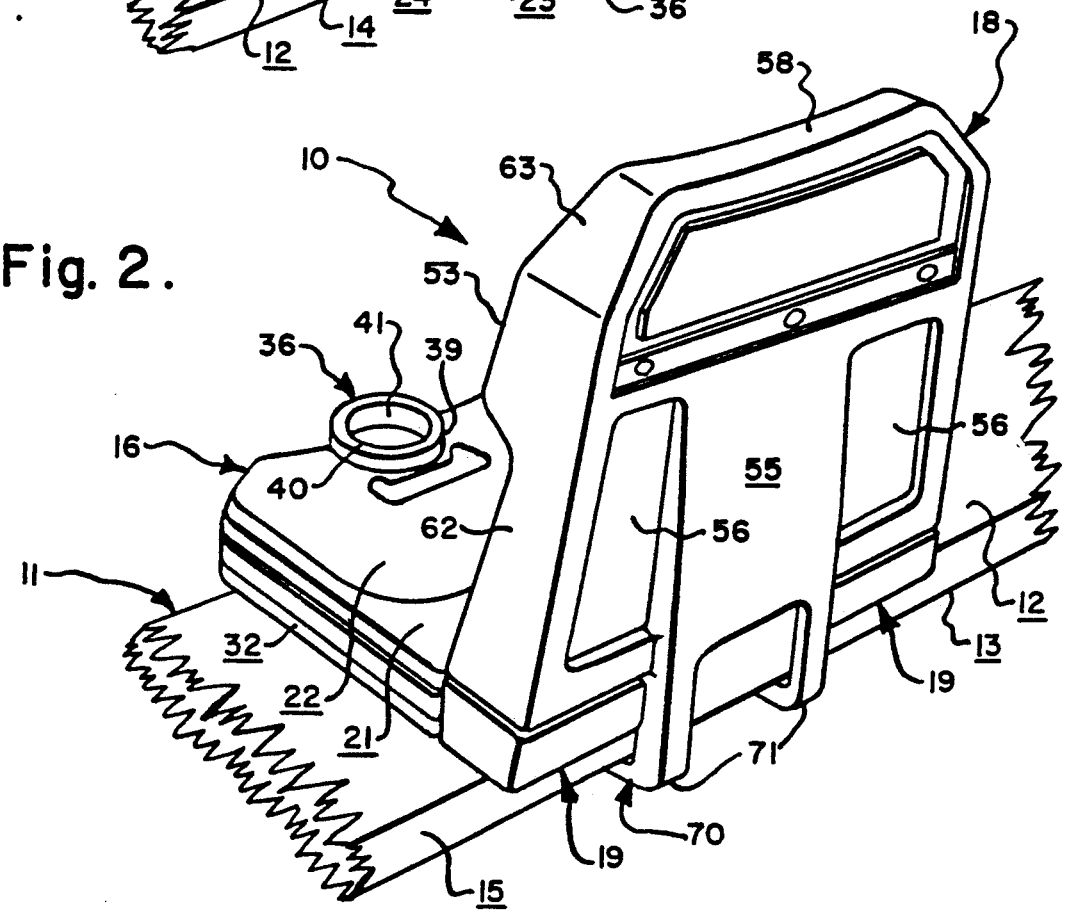
FIG. 2 is a right rear elevation of the seat assembly shown in FIG. 1, this view also showing the seat assembly in its upright position and capturing a portion of the bleacher between its opposed facing hook portions.

Back member 18 is shown as being specially-configured, and may be conveniently formed of a suitable high density polyethylene or equivalent, by a known blow molding technique. When the back member is in its upright position, as shown in FIGS. 1–3, the back member has a forwardly-facing surface which includes a support portion 53 and a recessed central portion 54 therebeneath. The back member also has a rearwardly-facing surface 55 provided with a plurality of strengthening depression, severally indicated at 56. The back member is further shown as including a peripheral side surface joining the front and back surfaces. This side surface sequentially includes: an upper surface 58, a rightwardly-and upwardly-facing inclined surface 59, an upwardly-and rightwardly-facing surface 60 continuing downwardly therefrom, a downwardly-facing planar surface 61, a leftwardly-and upwardly-facing surface 62, and a leftwardly-and rightwardly-facing planar surface 63 continuing upwardly therefrom to rejoin the right margin of upper surface 58. Since back member 18 is blow-molded, it is formed to have various recesses and configurations so as to enhance its strength and structural integrity.

Figure 5:
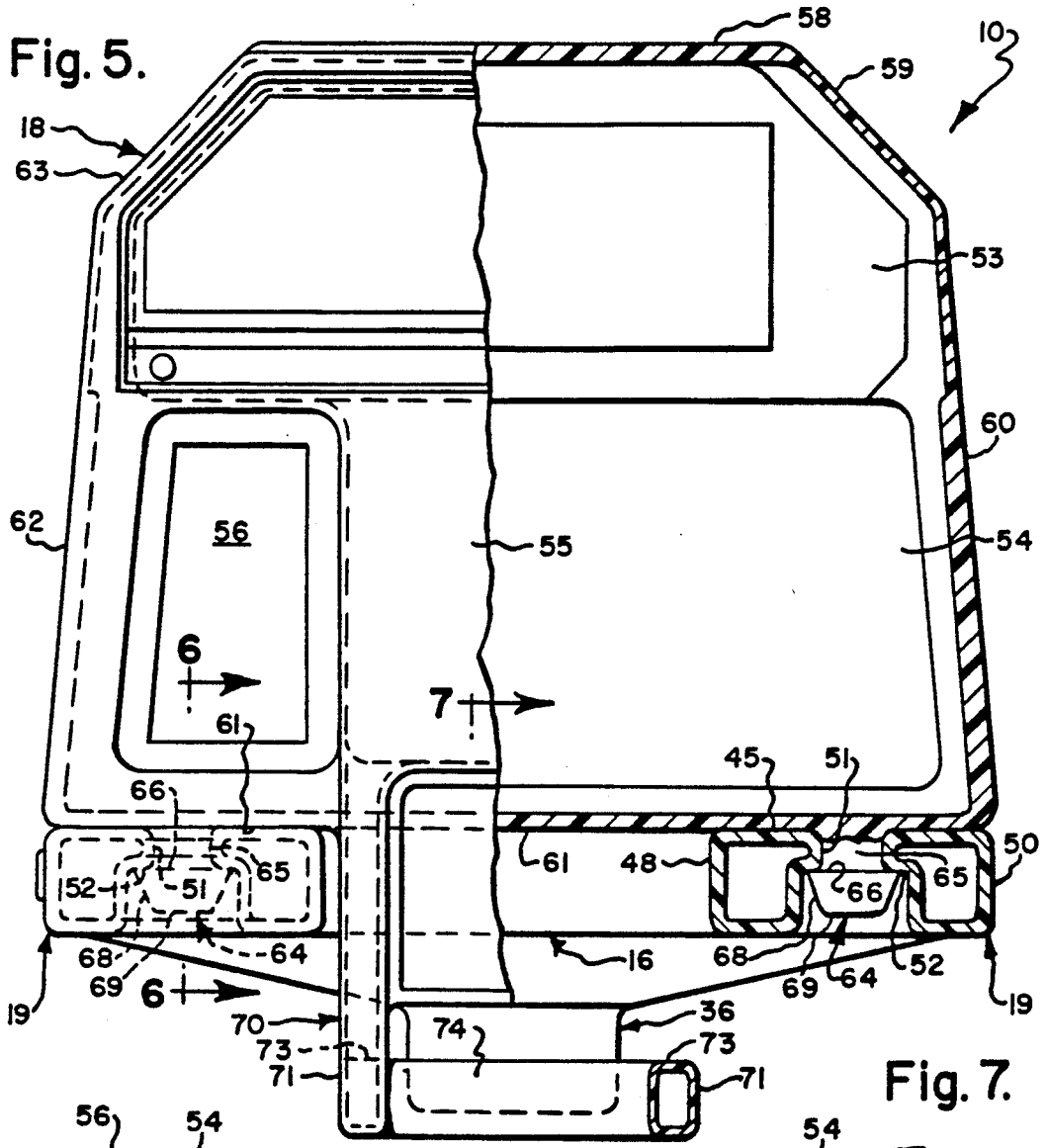
FIG. 5 is a rear view, partly in section and partly in elevation, of the improved seat assembly.
Figure 7:
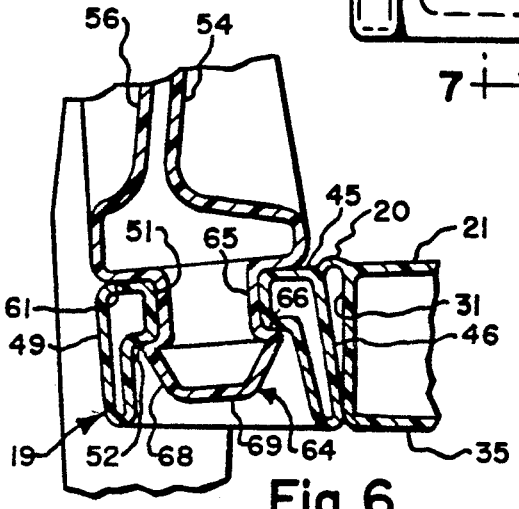
FIG. 7 is a fragmentary vertical sectional view thereof, taken generally on line 7—7 of FIG. 5, and showing the rearward hook portion in transverse vertical cross-section.

As best shown in FIGS. 5 and 6, two horizontally-spaced projections, severally indicated at 64 extend downwardly from back member lower surface 61. Each of these projections is shown as having a thin-walled cylindrical portion 65 extending downwardly from back member lower surface 61, an upwardly-facing annular shoulder 66, a inwardly-tapered frusto-conical surface 68 extending downwardly therefrom and terminating in a lowermost downwardly-facing planar surface 69. Projections 64,64 are adapted to be aligned with, and selectively inserted into, holes 51,51 in portions 19,19. When so inserted, the barbs on the projections (i.e., formed by the intersection of surface 66,68) will engage the downwardly-facing shoulder surfaces 52,52 on the underside of portions 19,19 immediately about openings 51,51. Thus, the entire seat assembly may be formed of two separate pieces, subsequently assembled together.

As best shown in FIGS. 3–5 and 7, the back member has an integrally-formed rearward hook portion, generally indicated at 70, formed therein. This hook portion includes two spaced L-shaped arms extending downwardly from the back member. The lower portion of these arms extend forwardly from the lower margins of the rear portions thereof. Thus, each of arms 71,71 has a forwardly-facing surface 72 adapted to face toward support rear surface 15, and has an upwardly-facing surface 73 adapted to underlie a portion of, and face toward, support lower surface 13. The distal ends of the arm lower portions are connected by a tubular cross-bar 74 having a cylindrical outer surface. Cross-bar 74 also functions as a carrying handle when the improved seat assembly is moved to its folded-flat condition, as shown in FIG. 4.

Thus, the seat may be folded forwardly through an arc of approximately 95° to its folded-flat condition, for ease in transport and handling. The improved seat may be readily moved to the site of a sporting event by merely grasping handle 74 and carrying the folded seat assembly. Once at the site of the event, the forward hook portion 36 is caused to embrace or capture a forward marginal portion of the support or bleacher seat. To facilitate dimensional variations, one or more spacers, severally indicated at 75 and 76, may be positioned between the seat member and/or the hook portions, and the support. Thereafter, the operator simply folds the back member 18 upwardly and rearwardly through an arc of approximately 95° to its operative or upright position. As back member 18 pivots about the axis defined by hinges 20,20 the rearward hook portion, with the intermediate spacers appropriately positioned if need be, passes around the rearward marginal end portion of the seat, as shown in FIG. 2. Hence, the seat is restrained from movement in a forward or rearward direction relative to the support. At the same time, the improved seat assembly provides a cushioned seat for a persor sitting thereon, as well as back support.

MODIFICATIONS

The present invention contemplates that many changes and modifications may be made. For example, the material of which the improved seat assembly is formed, may be readily changed or modified, as desired. The seat assembly need not necessarily be formed by blow-molding, although this is presently preferred. If blow-molded, the seat assembly may be formed of various strengthening ribs and depressions therein to insure its structural integrity. In the preferred form, the entire seat assembly is formed of two separate members, namely, seat member 16 and back member 18, subsequently assembled together. The improved seat assembly may be formed of a greater number of parts, if desired. The various panels on the seat assembly may bear advertising or promotional material, as desired.

Therefore, while the presently-preferred form of the improved portable seat assembly has been shown and described, and several modifications and changes thereof discussed, persons skilled in this art will readily appreciate the various additional changes and modifications may be made without departing fron the spirit of the invention, as defined and differntiated by the following claims.

What is claimed is:

1. A two-piece blow-molded portable seat assembly adapted to be selectively mounted on a support having an upper surface, a lower surface, a front surface and a rear surface, comprising:

a seat member having a lower surface adapted to rest on said support upper surface, and having an upper surface adapted to provide a seat for a person sitting thereon, said seat member also having a depending forward hook portion adapted to capture a forward marginal end portion of said support;

a back member pivotally mounted on said seat member and adapted to be selectively moved between a folded position at which said back member extends away from said seat member and is adapted to engage and support the back of a person sitting on said seat member, said back member having a depending rearward hook portion adapted to serve as a carrying handle when said back member is in said folded position and adapted to capture a rearward marginal end portion of said support when said back member is in said upright position, said back member having at least one lower back portion pivotally connected to said seat member by an integrally-formed flexible web and means for selectively interlocking said upper back portion with each lower portion to provide said back member;

whereby, when said back member is in said upright position and said hook portions engage such opposing marginal end portions of said support, said assembly will be restrained from moving forwardly or rearwardly relative to said support.

2. A two-piece blow-molded portable seat assembly as set forth in claim 1 wherein said forward hook portion is L-shaped, when seen in transverse cross-section, and includes a vertical portion adapted to face said support from surface, and a lower portion adapted to face toward said support lower surface.

3. A two-piece blow-molded portable seat assembly as set forth in claim 2 wherein said vertical portion has an upper surface, and wherein a blind recess extends downwardly with said vertical portion from said upper surface.

4. A two-piece blow-molded portable seat assembly as set forth in claim 1 wherein said rearward hook portion has a vertical portion adapted to face toward said supprt rear surface, and has a lower portion adapted to face toward said support lower surface.

5. A two-piece blow-molded portable seat assembly as set forth in claim 4 wherein said lower portion includes two spaced arms and a cross-bar extending therebetween, said cross-bar functioning as a carrying handle when said back member is in said folded position.

6. A two-piece blow-molded portable seat assembly as set forth in claim 1 wherein each lower back portion has a plurality of openings arranged face toward said upper back portion and wherein said upper back portion has a corresponding plurality of projections adapted to be received in said lower back portion openings to hold said upper and lower back portions together.

7. A two-piece blow-molded portable seat assembly as set forth in claim 6 wherein each of said projections has a catch surface adapted to capture a marginal portion of said lower back portion about said lower back portion openings to prevent unintended separation of said upper and lower back portions.

8. A two-piece blow-molded portable seat assembly as set forth in claim 1 and further comprising at least one spacer adapted to be positioned between said support and said seat assembly to accommodate a dimensional variation between the height of said forward hook member and the dimension between the upper and lower surface of said support.

9. A two-piece blow-molded portable seat assembly as set forth in claim 1 and further comoprising at least one spacer adapted to be positioned between said support and seat assembly toaccommodate a dimensional variation between the height of said rearward hook member and the dimension between said upper and lower surface of said support when said back member is in said upright position.

10. A two-piece blow-molded portable seat assembly as set forth in claim 1 and further comprising at least one spacer adapted to be positioned between said seat assembly and support to accommodate a dimensional variation between said front and rear surfaces of said support and the dimension between said hook members when said back member is in said upright position.

* * * * *